US008915293B2

(12) United States Patent
Agostini et al.

(10) Patent No.: US 8,915,293 B2
(45) Date of Patent: Dec. 23, 2014

(54) HEAT EXCHANGER

(75) Inventors: Bruno Agostini, Dietikon (CH); Francesco Agostini, Zofingen (CH)

(73) Assignee: ABB Research Ltd, Zurich (CH)

( * ) Notice: Subject to any disclaimer, the term of this patent is extended or adjusted under 35 U.S.C. 154(b) by 807 days.

(21) Appl. No.: 12/956,161

(22) Filed: Nov. 30, 2010

(65) Prior Publication Data

US 2011/0127011 A1 Jun. 2, 2011

(30) Foreign Application Priority Data

Nov. 30, 2009 (EP) ..... 09177484

(51) Int. Cl.

| | |
|---|---|
| ***F28D 15/00*** | (2006.01) |
| ***F28D 1/02*** | (2006.01) |
| ***F28F 9/02*** | (2006.01) |
| ***F28F 1/02*** | (2006.01) |
| ***F28D 15/02*** | (2006.01) |
| *F28D 1/053* | (2006.01) |

(52) U.S. Cl.

CPC ..... *F28F 1/022* (2013.01); *F28D 15/0266* (2013.01); *F28D 1/05391* (2013.01); *F28D 15/025* (2013.01); *F28D 2015/0225* (2013.01)

USPC ..... 165/104.21; 165/153; 165/174

(58) Field of Classification Search

USPC ..... 165/153, 174; 62/524, 525

See application file for complete search history.

(56) References Cited

U.S. PATENT DOCUMENTS

| | | | | |
|---|---|---|---|---|
| 5,205,347 | A * | 4/1993 | Hughes | 165/176 |
| 5,695,004 | A * | 12/1997 | Beckwith | 165/104.21 |
| 6,005,772 | A * | 12/1999 | Terao et al. | 361/699 |
| 6,272,881 | B1 * | 8/2001 | Kuroyanagi et al. | 62/525 |
| 6,725,908 | B2 * | 4/2004 | Suzuki | 165/104.21 |
| 2001/0040022 | A1 | 11/2001 | Hao | |
| 2002/0121359 | A1 | 9/2002 | Heikkila et al. | |
| 2004/0206490 | A1 * | 10/2004 | Katoh et al. | 165/174 |

(Continued)

FOREIGN PATENT DOCUMENTS

| | | |
|---|---|---|
| EP | 0 231 332 A1 | 8/1987 |
| JP | 8-189788 A | 7/1996 |

(Continued)

OTHER PUBLICATIONS

European Search Report issued on May 12, 2010 in Application No. EP 09177484.4.

*Primary Examiner* — Allen Flanigan
*Assistant Examiner* — Jason Thompson
(74) *Attorney, Agent, or Firm* — Buchanan Ingersoll & Rooney PC

(57) ABSTRACT

An exemplary heat exchanger includes evaporator channels and condenser channels, connecting parts for providing fluid paths between evaporator channels and the condenser channels, a first heat transfer element for transferring a heat load to a fluid in said evaporator channels, and a second heat transfer element for transferring a heat load from a fluid in the condenser channels. In order to achieve a heat exchanger that can be used in any position, the evaporator channels and said condenser channels can have capillary dimensions. The connecting part arranged at a first end of heat exchanger can include a first fluid distribution element for conducting fluid from a predetermined condenser channel into a corresponding predetermined evaporator channel, and the connecting part arranged at a second end of the heat exchanger can include a second fluid distribution element for conducting fluid from a predetermined evaporator channel into a corresponding predetermined condenser channel.

7 Claims, 5 Drawing Sheets

(56) References Cited

U.S. PATENT DOCUMENTS

| | | | | |
|---|---|---|---|---|
| 2005/0205239 | A1 | 9/2005 | Take | |
| 2006/0054310 | A1* | 3/2006 | Kim et al. | 165/110 |
| 2008/0117637 | A1* | 5/2008 | Chang et al. | 362/294 |
| 2009/0025914 | A1* | 1/2009 | Knight et al. | 165/144 |
| 2009/0056916 | A1* | 3/2009 | Yesin et al. | 165/104.21 |

FOREIGN PATENT DOCUMENTS

| | | | |
|---|---|---|---|
| JP | 2000-216578 | A | 8/2000 |
| WO | WO 87/00953 | A1 | 2/1987 |
| WO | WO 01/03484 | A1 | 1/2001 |
| WO | WO 03/056626 | A1 | 7/2003 |
| WO | WO 2006/077360 | A1 | 7/2006 |

* cited by examiner

HEAT EXCHANGER

RELATED APPLICATION

This application claims priority under 35 U.S.C. §119 to European Patent Application No. 09177484.4 in Europe on Nov. 30, 2009, the entire content of which is hereby incorporated by reference in its entirety.

FIELD

This disclosure relates to a heat exchanger, such as a heat exchanger suitable for use in cooling electronic apparatuses.

BACKGROUND INFORMATION

A heat exchanger in accordance with EP 2031332 A1 includes evaporator channels and condenser channels extending between a first and a second end of the heat exchanger. The opposite ends of the heat exchanger are provided with connecting parts that provide fluid paths between the evaporator channels and the condenser channels. A first heat transfer element is arranged in a vicinity of the first end of the heat exchanger for transferring a heat load to a fluid in said evaporator channels. Similarly, a second heat transfer element is arranged in a vicinity of the second end of the heat exchanger for transferring a heat load of from a fluid in the condenser channels to surroundings.

The above described heat exchanger is very efficient in cooling down, for instance, power electronics which have been attached to the first heat transfer element. Due to a construction of thermosyphon type, the cooling can be achieved without a need for a pumping unit.

However, the above-described heat exchanger needs to be installed in a specific position in order to work properly. Such a restriction can be problematic, because the heat exchanger cannot be installed in an upside down or horizontal position.

SUMMARY

A heat exchanger is disclosed, comprising: evaporator channels extending between a first end and a second end of said heat exchanger; condenser channels extending between the first end and the second end of said heat exchanger; a first connecting part and a second connecting part arranged at said first end and the second end, respectively, of said heat exchanger, the first connecting part and the second connecting part providing fluid paths between said evaporator channels and said condenser channels; a first heat transfer element arranged in a vicinity of said first end for transferring a heat load to a fluid in said evaporator channels; and a second heat transfer element arranged in a vicinity of said second end for transferring a heat load from a fluid in said condenser channels, wherein said evaporator channels and said condenser channels have capillary dimensions, wherein said evaporator channels and said condenser channels are arranged grouped together into at least a first group and a second group, each group including at least one evaporator channel and at least one condenser channel, wherein said first connecting part arranged at said first end of said heat exchanger comprises a first fluid distribution element arranged to conduct fluid from at least one predetermined condenser channel of said first group into at least one corresponding predetermined evaporator channel of said second group, and wherein said second connecting part arranged at said second end of said heat exchanger comprises a second fluid distribution element arranged to conduct fluid from at least one predetermined evaporator channel of said first group into at least one corresponding predetermined condenser channel of the first group.

BRIEF DESCRIPTION OF DRAWINGS

A further explanation of the disclosure and exemplary advantages is set forth in the following description of exemplary embodiments using the figure drawings, in which.

DETAILED DESCRIPTION

Exemplary embodiments of a heat exchanger according to the present disclosure need not be installed in a specific position in order to work properly, and can provide a inexpensive and reliable heat exchanger which is less sensitive to the position in which the heat exchanger is installed.

In accordance with an exemplary embodiment of the disclosure, connecting parts of first and second ends of a heat exchanger can be provided with fluid distribution elements that conduct fluid from predetermined condenser channels to predetermined evaporator channels and vice versa. This arrangement can enable the heat exchanger to work as a Pulsated Heat Pipe (PHP). In such a solution, with condenser channels and evaporator channels having capillary dimensions, oscillations can occur in a small channel loop heat pipe due to the bidirectional expansion of vapour inside the channels. Consequently, the disclosed heat exchanger can work in any orientation, without significant additional costs.

Figure 1:
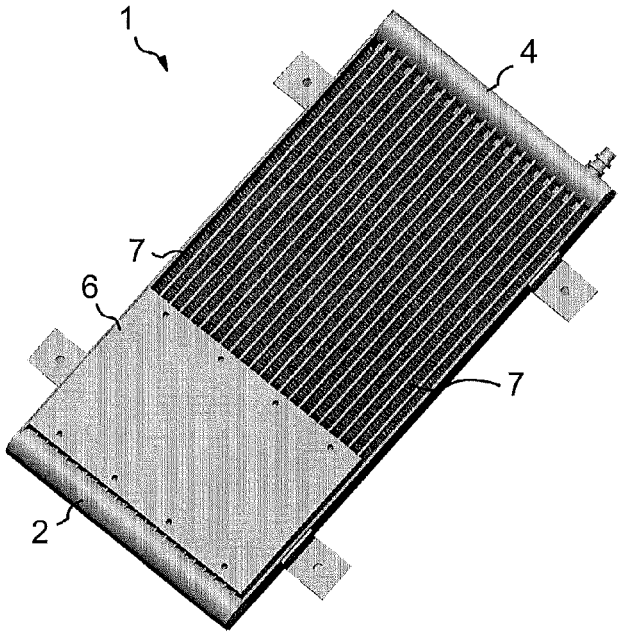
FIG. 1 illustrates a first exemplary embodiment of a heat exchanger.
Figure 2:
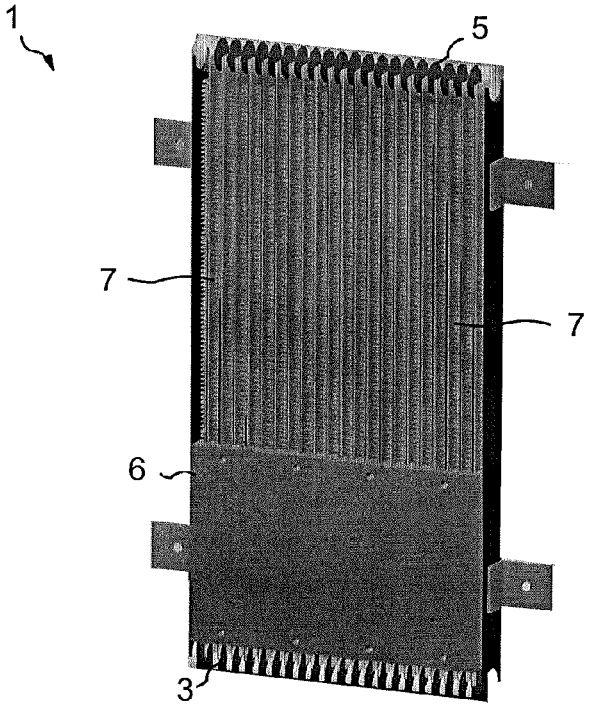
FIG. 2 illustrates the exemplary heat exchanger of FIG. 1 with connecting parts removed.

FIG. 1 illustrates a first exemplary embodiment of a heat exchanger 1, and FIG. 2 illustrates the exemplary heat exchanger 1 of FIG. 1 with connecting parts removed.

With reference to FIGS. 1 and 2, the exemplary heat exchanger 1 can include condenser channels and evaporator channels extending between a first and a second end of the heat exchanger 1. A first connecting part 2 can be arranged at a first end of the heat exchanger 1 for providing a fluid path between the condenser channels and the evaporator channels. The first connecting part 2 can include a first fluid distribution element 3 for conducting fluid from a predetermined condenser channel into a corresponding predetermined evaporator channel, as explained in more detail in connection with FIG. 3.

A second connecting part 4 can be arranged at a second end of the heat exchanger 1 for providing a fluid path between the evaporator channels and the condenser channels. The second connecting part 4 can include a second fluid distribution element 5 for conducting fluid from a predetermined evaporator channel into a corresponding predetermined condenser channel, as explained in more detail in connection with FIG. 4.

The evaporator channels and condenser channels can have capillary dimensions. In this context "capillary dimensions" refers to channels that are capillary sized, in which case the channels can have a size small enough so that bubbles can grow uniquely in a longitudinal direction (in other words in the flow direction as opposed to the radial direction) and thereby create a pulsating effect by pushing the liquid.

The exemplary heat exchanger 1 can also include a first heat transfer element 6 arranged in a vicinity of the first end of the heat exchanger 1, for transferring a heat load to a fluid in the evaporator channels. The heat exchanger of FIG. 1 can be used, for example, in an electronics apparatus (e.g. a frequency converter) for conducting heat away from components generating a significant heat load. When an exemplary heat exchanger as disclosed herein is used in an electronics apparatus, electronic circuits of the electronics apparatus can be attached to the first heat transfer element. The heat transfer element 6 can conduct the heat load to the evaporator channels containing a fluid that, during use, cools down the first heat transfer element 6.

The exemplary heat exchanger 1 can also include a second heat transfer element 7 which can include fins extending between walls of the condenser channels in order to transfer heat from fluid in the condenser channels to surroundings.

Figure 3:
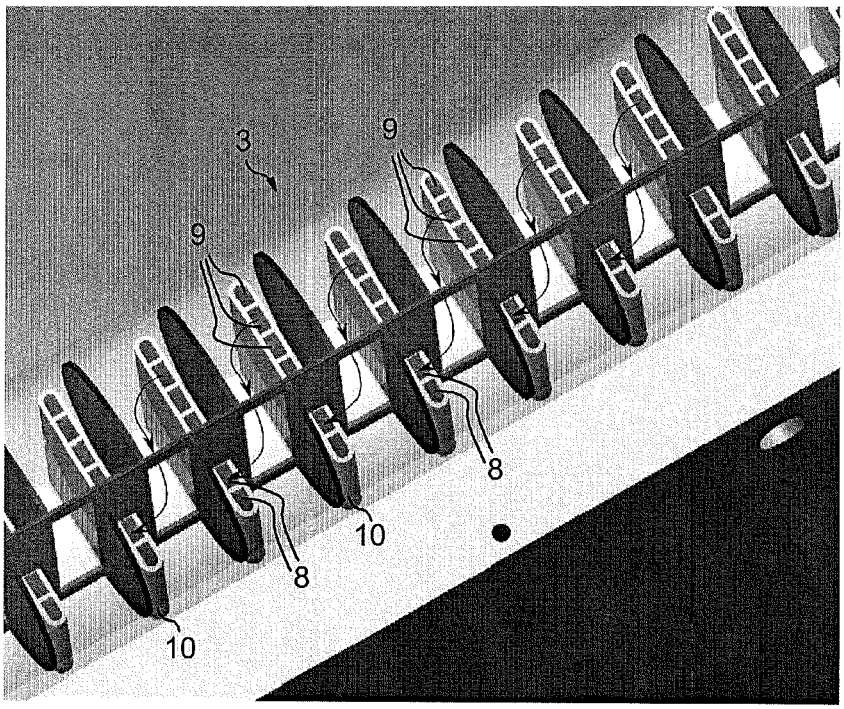
FIG. 3 illustrates an exemplary heat exchanger with a first distribution element.

FIG. 3 illustrates an exemplary heat exchanger with a first distribution element 3. Evaporator channels 8 and the condenser channels 9 are shown grouped together into a plurality of groups. Each group can include at least one evaporator channel 8 and at least one condenser channel 9. In the illustrated exemplary embodiment, the heat exchanger includes a plurality of parallel pipes 10 extending between the first end and the second end of the heat exchanger. These pipes 10 have been divided into evaporator channels 8 and condenser channels 9 by internal walls of the pipes 10. Thus each pipe 10 includes a group consisting of two evaporator channels 8 and four condenser channels 9 in the illustrated example. The foregoing configuration of two evaporator channels and four condenser channels is by way of example. Any combination of evaporator channels and condenser channels is possible, depending, for example, on specified performances.

The evaporator channels 8 and the condenser channels 9 can have capillary dimensions. In the exemplary embodiment shown in FIG. 3, the evaporator channels 8 and the condenser channels 9 can be capillary sized so that no additional capillary structures are needed on their internal walls. The diameter of a channel or tube which is considered capillary depends on the fluid that is used inside (e.g., boiling). The following formula, for instance, can be used to evaluate a suitable diameter:

$$D=(\text{sigma}/(g*(\text{rho}l-\text{rho}v)))\hat{}0.5,$$

where sigma is the surface tension, g is the acceleration of gravity, rhov is the vapor density, and rhol is the liquid density. This formula gives values from 1 to 3 mm for R134a (Tetrafluoroethane), R145fa and R1234ze (Tetrafluoropropene), which are examples of fluids suitable for use in heat exchangers in accordance with an exemplary embodiment of the disclosure. The length of the exemplary heat exchanger can be from about 20 cm to 2 m, for example, or even more.

The first distribution element 3 can be arranged to conduct fluids from one or more condenser channels 9 into one or more evaporator channels 8. In an exemplary embodiment, the fluid from each one of the four condenser channels 9 of a group can be conducted by the distribution element 3 into the two evaporator channels 8 of a group located to the left, as shown in FIG. 3.

Figure 4:
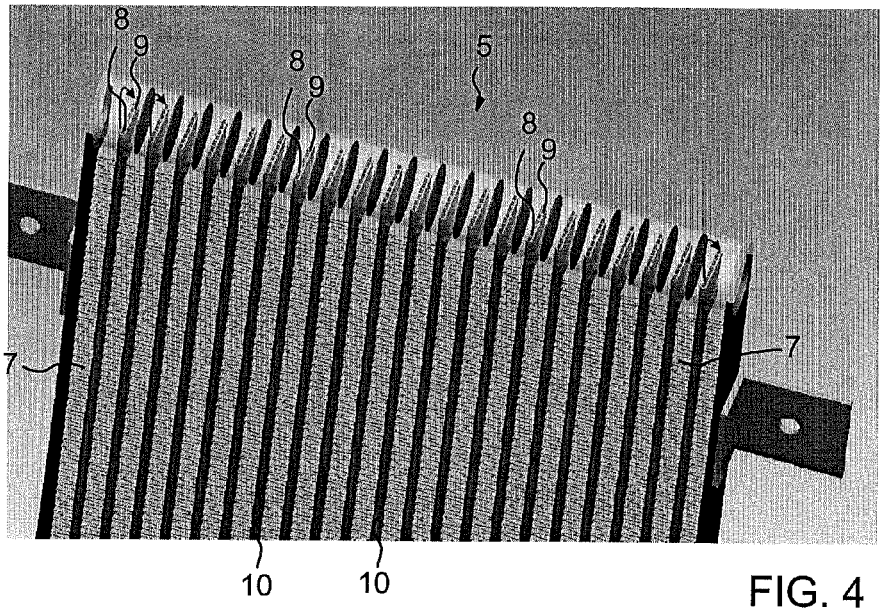
FIG. 4 illustrates an exemplary heat exchanger with a second distribution element.

FIG. 4 illustrates an exemplary heat exchanger with a second distribution element 5. The second distribution element 5 can conduct fluids from one or more evaporator channels 8 into one or more condenser channels 9. In the exemplary embodiment shown in FIG. 4, the fluid from each one of the two evaporator channels 8 of a group can be conducted by the distribution element into the four condenser channels 9 of the same group.

The exemplary heat exchanger 1 as explained in connection with FIGS. 1 to 4 can have a construction resembling the construction of a Compact Thermosyphon Heat Exchanger (COTHEX). However, the evaporator and condenser channels of the exemplary heat exchanger 1 can have capillary dimensions and the connecting parts of the first and second ends can be provided with fluid distribution elements that conduct fluid from predetermined condenser channels to predetermined evaporator channels and vice versa. This feature can make it possible to have the heat exchanger work as a Pulsated Heat Pipe (PHP). In such an arrangement, oscillations can occur in a small channel loop heat pipe due to a bidirectional expansion of vapour inside the channels. During operation, the liquid can slug, and elongated vapour bubbles can oscillate between a cold region and a hot region because of hydrodynamic instabilities caused by rapid expansion of the bubbles confined in the small channels, and thus provide a fluid velocity almost independent of gravity. Consequently, the exemplary heat exchanger 1 can work in any orientation (with some possible performance change depending on the orientation, however).

Figure 5:
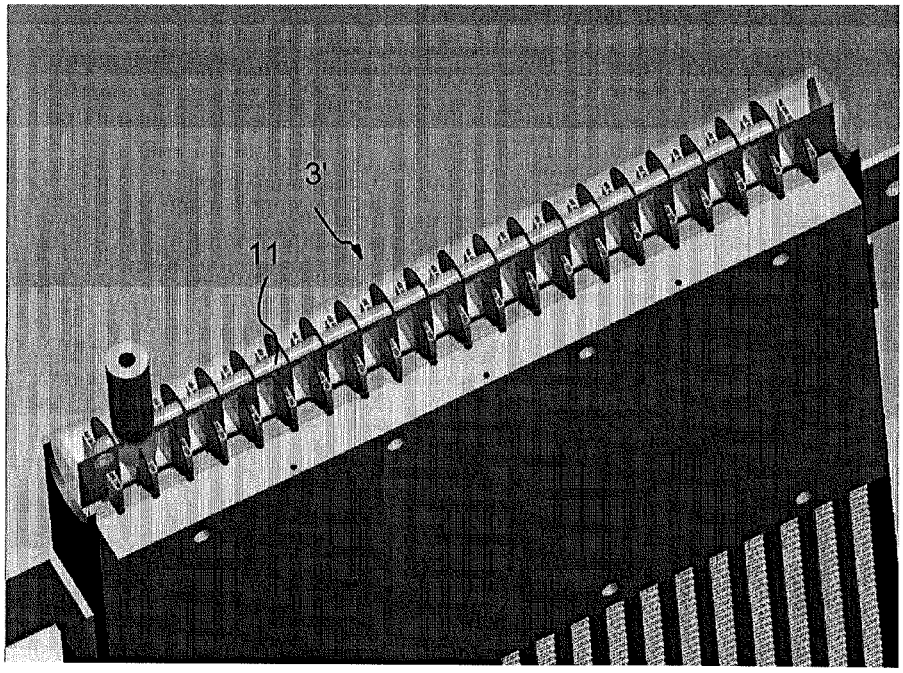
FIG. 5 illustrates an exemplary heat exchanger with an exemplary first alternative first distribution element.

FIG. 5 illustrates an exemplary heat exchanger with an exemplary first alternative example of a first distribution element 3'.

When the first distribution element 3 illustrated in FIG. 3 is used in the heat exchanger of FIGS. 1, 2, and 4, the heat exchanger 1 can operate as an open loop pulsating heat pipe. However, if the first alternative first distribution element 3' illustrated in FIG. 5 is instead used in the heat exchanger of FIGS. 1, 2, and 4, a closed loop pulsating heat pipe can be obtained. The exemplary embodiment shown in FIG. 5 differs from the embodiment of FIGS. 1, 2, and 4 in that the heat exchanger of FIG. 5 can have a channel 11 arranged to conduct fluid from one or more condenser channels of the last one of the groups (located rightmost in FIG. 5) into one or more evaporator channels of the first one of the groups (located leftmost in FIG. 5). Consequently, fluid of the exemplary embodiment of FIG. 5 can be allowed to pass via the channel 11 from the rightmost condenser channels to the leftmost evaporator channels.

In the exemplary embodiment of FIG. 5, the second distribution element 5 shown in FIGS. 1, 2, and 4 can be used in the second end of the heat exchanger.

Figure 6:
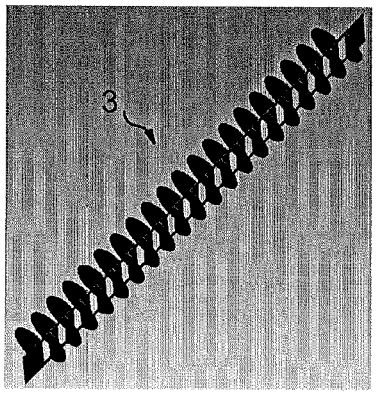
FIG. 6 illustrates details of the first distribution element of FIG. 3.

FIG. 6 illustrates exemplary details of the first distribution element 3 of FIG. 3. The distribution element can be manufactured as a separate part that can be inserted into the connecting part 2 at the first end of the heat exchanger 1.

Figure 7:
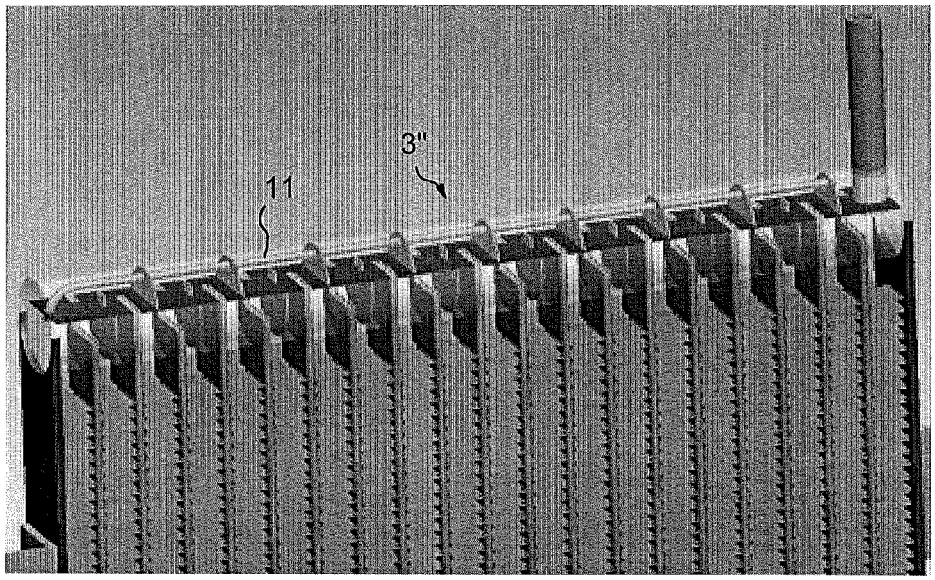
FIG. 7 illustrates an exemplary heat exchanger with an exemplary second alternative first distribution element.

FIG. 7 illustrates a heat exchanger with an exemplary second alternative first distribution element 3". If the second alternative distribution element 3" is used in the heat exchanger of FIGS. 1, 2, and 4, a closed loop pulsating heat pipe can be obtained. Similar to the exemplary embodiment of FIG. 5, the exemplary embodiment shown in FIG. 7 can include a channel 11 arranged to conduct fluid from one or more condenser channels of the last one of the groups into one or more evaporator channels of the first one of the groups.

Figure 8:
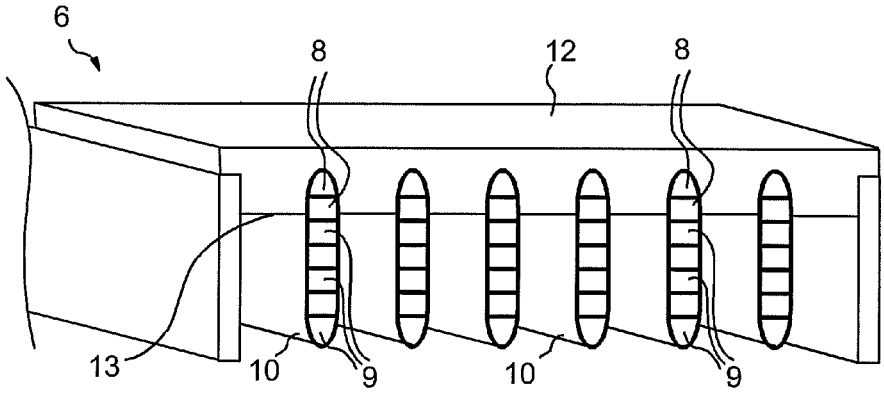
FIG. 8 illustrates an exemplary first heat transfer element.

FIG. 8 illustrates an exemplary first heat transfer element 6, which can be attached to a heat exchanger, such as the heat exchanger of FIG. 1. The first heat transfer element 6 can include a first surface 12 for receiving electronic components, and a second surface 13 for contacting walls of the evaporator channels 8. By this arrangement, heat generated by the electronic components attached to the first surface 12 can be transferred to the fluid in the evaporator channels. FIG. 8 also illustrates an exemplary arrangement in which the evaporator channels 8 partly penetrate into grooves in the second surface 13 of the first heat transfer element. Such an arrangement can increase the contact surface between the evaporator channels 8 and the second surface 13.

Figure 9:
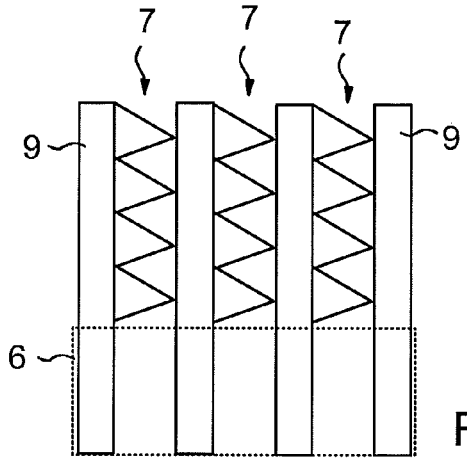
FIG. 9 illustrates an exemplary second heat transfer element.

FIG. 9 illustrates an exemplary second heat transfer element 7. The second heat transfer element 7 can include fins extending between walls of said condenser channels 9. This arrangement can facilitate transfer of heat from the fluid in the condenser channels 9 to the surroundings via the fins. In an exemplary embodiment, a fan can be used in connection with the second heat transfer element 7. The fan can facilitate generation of an airflow between the fins, which can increase the heat transfer from the second heat transfer element 7 to the surroundings.

In FIG. 9, the first heat transfer element 6 has been illustrated by dashed lines in order to show that the first heat transfer element 6 and the second heat transfer element can contact the pipes containing the condenser channels 9 and the evaporator channels at different ends of the pipes. In addition, the fins can be arranged on the tubes 10 containing the condenser channels and the evaporator channels in such a way that fins contact the outer walls of the tubes 10 only in the regions of the tubes where the condenser channels are located. In other words, in this exemplary arrangement, no fins are arranged in the part of the tubes 10 which are shown to penetrate into the grooves (e.g., those shown in FIG. 8) of the first heat transfer element.

Figure 10:
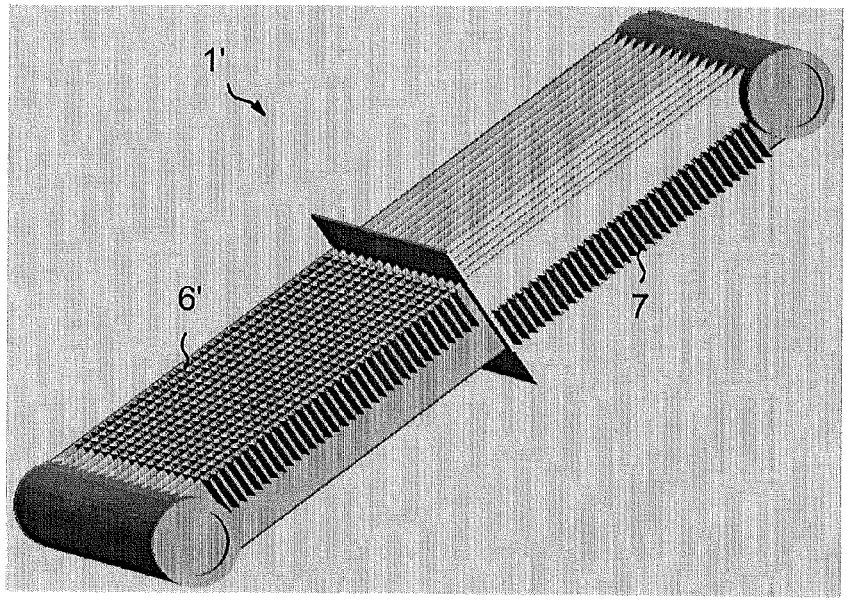
FIG. 10 illustrates a second exemplary embodiment of a heat exchanger.

FIG. 10 illustrates a second exemplary embodiment of a heat exchanger 1'. The exemplary heat exchanger 1' of FIG. 10 is related to the one illustrated in FIGS. 1 and 2. Therefore the embodiment of FIG. 10 will be explained herein mainly by referring to the differences between these embodiments.

In FIGS. 1 and 2, the first heat transfer element 6 is presented as a plate where electronic circuits can be attached. The plate can allow heat to be conducted from the plate to the evaporator channels containing fluid.

In the exemplary embodiment shown in FIG. 10, however, the first heat transfer element 6' can include fins extending between walls of the evaporator channels 8. Therefore, heat from the surroundings of the heat transfer element 6' can be transferred via the fins to the fluid in the evaporator channels 8. Optionally, an airstream can be generated to pass via the fins of the first heat transfer element 6' in order to obtain a sufficient heat transfer, if desired.

It is to be understood that the above description and the accompanying figures are only intended to illustrate the present disclosure. It will be obvious to a person skilled in the art that the invention can be varied and modified without departing from the scope of the invention. In particular it should be observed that the design of the distribution elements provided as an example only as also other designs are possible.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A heat exchanger, comprising:

evaporator channels extending between a first end and a second end of said heat exchanger;

condenser channels extending between the first end and the second end of said heat exchanger;

a first connecting part and a second connecting part arranged at said first end and the second end, respectively, of said heat exchanger, the first connecting part and the second connecting part providing fluid paths between said evaporator channels and said condenser channels;

a first heat transfer element arranged in a vicinity of said first end for transferring a heat load to a fluid in said evaporator channels; and a second heat transfer element arranged in a vicinity of said second end for transferring a heat load from a fluid in said condenser channels, wherein said evaporator channels and said condenser channels have capillary dimensions, wherein said evaporator channels and said condenser channels are arranged grouped together into at least a first group and a second group, each group including at least one evaporator channel and at least one condenser channel, wherein said first connecting part arranged at said first end of said heat exchanger comprises a first fluid distribution element arranged to conduct fluid from at least one predetermined condenser channel of said first group only into at least one corresponding predetermined evaporator channel of said second group, and wherein said second connecting part arranged at said second end of said heat exchanger comprises a second fluid distribution element arranged to conduct fluid from the at least one predetermined evaporator channel of said first group only into the at least one corresponding predetermined condenser channel of the first group.

2. The heat exchanger according to claim 1, wherein said evaporator channels and condenser channels comprise:

channels separated by internal walls of a plurality of parallel pipes, each pipe having at least one evaporator channel and at least one condenser channel.

3. The heat exchanger according to claim 1, wherein said first fluid distribution element comprises:

a channel arranged to conduct fluid from at least one condenser channel of said second group into at least one evaporator channel of said first group.

4. The heat exchanger according to claim 1, wherein said first heat transfer element comprises:

a first surface for receiving electronic components; and a second surface for contacting walls of said evaporator channels in order to transfer heat generated by said electronic components to fluid in said evaporator channels.

5. The heat exchanger according to claim 1, wherein said first heat transfer element comprises:

fins extending between walls of said evaporator channels in order to transfer heat from surroundings of the first heat transfer element to fluid in evaporator channels.

6. The heat exchanger according to claim 1, wherein said second heat transfer element comprises:

fins extending between walls of said condenser channels in order to transfer heat from fluid in condenser channels to surroundings via said fins.

7. The heat exchanger according to claim 1, wherein the first group and the second group form separate fluid paths.

* * * * *